US010731950B2

(12) United States Patent
Mercier

(10) Patent No.: US 10,731,950 B2
(45) Date of Patent: Aug. 4, 2020

(54) VEHICLE DEFENSE PROJECTILE

(71) Applicant: BAE Systems Information and Electronic Systems Integration Inc., Nashua, NH (US)

(72) Inventor: Michael N. Mercier, Nashua, NH (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 0 days.

(21) Appl. No.: 16/164,894

(22) Filed: Oct. 19, 2018

(65) Prior Publication Data

US 2020/0124385 A1 Apr. 23, 2020

(51) Int. Cl.

| | |
|---|---|
| ***F41H 11/02*** | (2006.01) |
| ***F41H 13/00*** | (2006.01) |
| ***F42B 12/22*** | (2006.01) |

(52) U.S. Cl.

CPC ..... *F41H 11/02* (2013.01); *F41H 13/0031* (2013.01); *F42B 12/22* (2013.01)

(58) Field of Classification Search

CPC .. F41H 11/02; F42B 5/15; F42B 12/48; F42B 12/70; H04K 3/00; G01S 7/38; G01S 7/495

See application file for complete search history.

(56) References Cited

U.S. PATENT DOCUMENTS

| | | | | |
|---|---|---|---|---|
| 7,100,514 | B2 * | 9/2006 | LeBourgeois | F41H 13/0031 102/502 |
| 7,421,951 | B2 * | 9/2008 | Genis | F42B 12/54 102/502 |
| 7,690,288 | B2 * | 4/2010 | Calico | F42C 11/02 102/210 |
| 9,329,007 | B2 * | 5/2016 | Krauss | F42B 10/38 |

FOREIGN PATENT DOCUMENTS

| | | | | |
|---|---|---|---|---|
| GB | 2384042 A | * | 7/2003 | F41H 13/0031 |
| JP | 2003042695 A | * | 2/2003 | |

* cited by examiner

*Primary Examiner* — Joshua T Semick

(74) *Attorney, Agent, or Firm* — Sand, Sebolt & Wernow LPA; Scott J. Asmus

(57) ABSTRACT

A projectile round for intercepting an incoming threat to a vehicle or the like is provided. The projectile round may include an explosive layer, which upon detonation, may cause a the fracturing of one or more material layers into one or both of shrapnel and chaff while simultaneously causing the distortion and/or destruction of a piezoelectric material contained within the projectile round. The distortion and/or destruction of this piezoelectric material may further cause the release of an electromagnetic pulse. The projectile round may be part of a countermeasure system against guided munition threats, including those posed by man-portable air defense systems.

13 Claims, 6 Drawing Sheets

VEHICLE DEFENSE PROJECTILE

BACKGROUND

Technical Field

The present disclosure relates to an explosive projectile. More particularly, in one example, the present disclosure relates to a hard-kill counter measure projectile round to counter a guided missile threat. Specifically, in another example, the present disclosure relates to a projectile round launched at a guided missile threat that, when detonated, can produce multiple countermeasures against the threat.

Background Information

Modern military vehicles, including tanks, personnel carriers, trucks, aircraft, and ships face ever-increasing threats as they operate in hostile areas. One particular threat is that of man-portable air-defense systems (MANPADS) which are shoulder-launched missiles, including surface-to-air missiles. MANPADS are often guided missiles that can be directed to their target utilizing infrared targeting, line-of-sight targeting, and/or laser guided targeting.

Additionally, many of the more modern missiles in use have counter-countermeasures (CCM) designed to reduce the performance of vehicle countermeasures (CM) such as traditional jamming or intercept techniques thereby increasing the likelihood of a successful strike. These current defensive techniques designed to combat these guided missile threats, including radio-frequency jammers, are becoming less effective as these threat missiles become more advanced. Other defensive techniques, such as infrared laser and/or flare-based countermeasures, which are designed to confuse and/or cause the attacking threat to detonate prematurely, are likewise becoming less effective as the threats continue to adapt and evolve.

SUMMARY

The present disclosure addresses these and other issues by providing a projectile round that can be propelled towards an attacking threat and may release multiple countermeasures. Specifically, the projectile round provided herein has an explosive device operable to deploy shrapnel in an attempt to physically damage or deflect the attacking threat. Secondly, upon detonation, the projectile round releases chaff in an attempt to trigger a proximity fuse and confuse the guidance system within the missile. Third, detonation of the projectile round may destroy a piezoelectric component contained within the projectile round, thereby releasing an electromagnetic pulse (EMP) in an attempt to destroy or degrade the electronic systems within the attacking threat.

In one aspect, the present disclosure may provide a projectile round comprising: a piezoelectric core; a layer of explosive material surrounding the core; an outer layer forming a shell enclosing the layer of explosive material and the core therein; and a fuse operable to cause the layer of explosive material to detonate. This exemplary embodiment or another exemplary embodiment may further provide wherein the piezoelectric core is a piezoelectric crystal. This exemplary embodiment or another exemplary embodiment may further provide wherein the outer layer fragments upon detonation of the explosive material layer and becomes one of shrapnel and chaff. This exemplary embodiment or another exemplary embodiment may further provide wherein the outer layer fragments upon detonation of the explosive material layer and becomes both shrapnel and chaff. This exemplary embodiment or another exemplary embodiment may further provide an inner layer between the layer of explosive material and the outer layer. This exemplary embodiment or another exemplary embodiment may further provide wherein the inner layer fragments upon detonation of the explosive material layer and becomes one of shrapnel and chaff. This exemplary embodiment or another exemplary embodiment may further provide wherein the inner layer fragments upon detonation of the explosive material layer and becomes chaff and wherein the outer layer fragments upon detonation of the explosive material layer and becomes shrapnel. This exemplary embodiment or another exemplary embodiment may further provide wherein the projectile round is a ballistics projectile round. This exemplary embodiment or another exemplary embodiment may further provide wherein the projectile round is an actively propelled projectile round. This exemplary embodiment or another exemplary embodiment may further provide wherein the piezoelectric crystal core is destroyed upon detonation of the explosive material layer thereby releasing an electromagnetic pulse (EMP). This exemplary embodiment or another exemplary embodiment may further provide a rocket motor; and, a fuel supply; wherein the rocket motor is operable to actively propel the projectile round. This exemplary embodiment or another exemplary embodiment may further provide wherein the fuse is a proximity fuse. This exemplary embodiment or another exemplary embodiment may further provide wherein the fuse is a timed fuse.

In another aspect, the present disclosure may provide a method of intercepting an incoming threat comprising: detecting an incoming threat; propelling a projectile round towards the incoming threat; detonating an explosive layer within the projectile round via a fuse; causing one of shrapnel or chaff to deploy from the projectile round towards the incoming threat via the detonation of the explosive layer; and, generating an electromagnetic pulse (EMP) from the projectile round in the vicinity of the incoming threat. This exemplary embodiment or another exemplary embodiment may further provide wherein generating the EMP occurs in response to detonating the explosive material layer. This exemplary embodiment or another exemplary embodiment may further provide wherein generating the EMP occurs by destroying a piezoelectric material within the projectile round in response to detonating the explosive material layer. This exemplary embodiment or another exemplary embodiment may further provide destroying a natural piezoelectric material within the projectile round. This exemplary embodiment or another exemplary embodiment may further provide destroying a man-made piezoelectric material within the projectile round. This exemplary embodiment or another exemplary embodiment may further provide causing both shrapnel and chaff to deploy from the projectile round in response to detonating the explosive layer. This exemplary embodiment or another exemplary embodiment may further provide deploying at least one additional countermeasure against the incoming threat contemporaneously with propelling the projectile round towards the incoming threat. This exemplary embodiment or another exemplary embodiment may further provide wherein the at least one additional countermeasure is selected from a group comprising an infrared laser countermeasure (IRCM), one or more flares, and both an IRCM and one or more flares.

BRIEF DESCRIPTION OF THE SEVERAL VIEWS OF THE DRAWINGS

Sample embodiments of the present disclosure are set forth in the following description, is shown in the drawings and is particularly and distinctly pointed out and set forth in the appended claims.

Similar numbers refer to similar parts throughout the drawings.

DETAILED DESCRIPTION

Figure 1A:
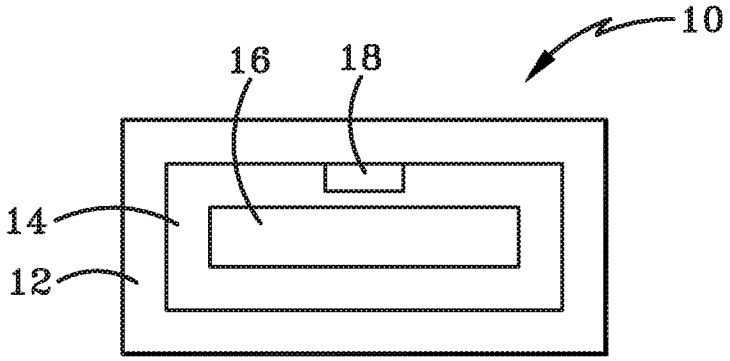
FIG. 1A (FIG. 1A) is a schematic view of a projectile round of the present disclosure.
Figure 1B:
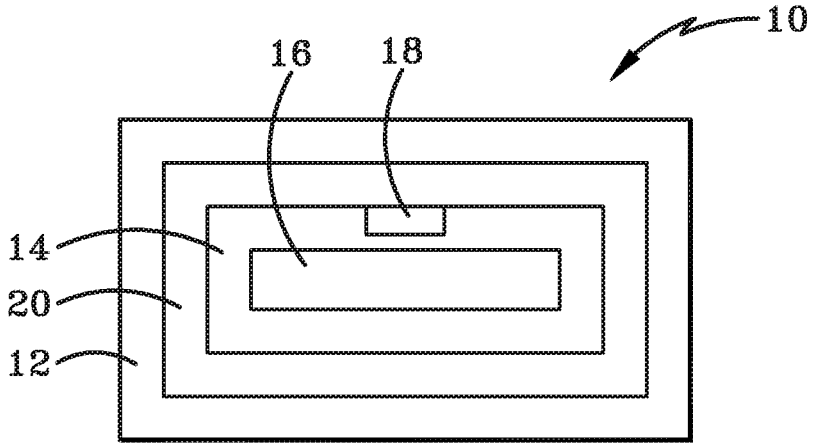
FIG. 1B (FIG. 1B) is a schematic view of an alternate embodiment of a projectile round of the present disclosure.

With reference to FIG. 1A, a projectile round 10 of the present disclosure can be, in its most basic form, a layered structure including an outer layer 12, an explosive layer 14, a core 16, and a fuse 18 in contact with or disposed within the explosive layer 14. According to one aspect, projectile round 10 may further include an inner layer 20 as illustrated in FIG. 1B.

Outer layer 12 may form a casing or a shell which can enclose explosive layer 14, core 16, and fuse 18 therein. According to one aspect, outer layer 12 can be a metal or metal alloy which can fragment upon detonation of explosive layer 14 as discussed further herein.

Explosive layer 14 may be a high explosive or other known explosive material and can be configured to fit within outer layer 12 so long as it contains or is otherwise in contact with fuse 18 such that fuse 18 may trigger detonation of the explosive layer 14 as further discussed herein. According to one aspect, explosive material layer 14 may include or otherwise be a shaped charge which is configured to focus explosive force in a desired direction upon detonation according to the desired implementation thereof. Further according to this aspect, projectile round 10 may include a shaping liner or structure (not shown) to realize this or similar effects.

Core 16 may be a material having piezoelectric properties. Specifically, core 16 may be a material that is capable of producing an electric charge when deformed or destroyed a piezoelectric crystal or other piezoelectric material capable of producing an electric charge when deformed or destroyed. Core 16 may be contained within or in close proximity to explosive layer 14 such that the detonation of explosive layer 14 can cause significant deformation and/or complete destruction of core 16. As discussed further herein, the deformation and/or destruction of core 16 can cause the release of electrical energy in the form of an electromagnetic pulse (EMP).

According to one aspect, core 16 may be a naturally occurring material having piezoelectric properties. Examples of these naturally occurring materials may include quartz, berlinite, sucrose, Rochelle salt, topaz, tourmaline-group minerals, or macedonite. According to another aspect, core 16 may be a synthetic, or man-made, material having piezoelectric properties, including langasite, gallium orthophosphate, lithium niobate, or lithium tantalite. According to another aspect, core 16 may be any other material having known piezoelectric properties, including some ceramics, nanostructured semiconductor crystals, some polymers, or some organic nanostructures. According to another aspect, core 16 may be a crystalline structure, or crystal, of one or more of the above indicated piezoelectric material examples.

Fuse 18 can be any known type of fuse appropriate for the desired implementation. Fuse 18 may be located at any suitable position within outer layer 12 of projectile round 10 so long as fuse 18 is contact with explosive layer 14 and operable to cause the detonation thereof.

Figure 4:
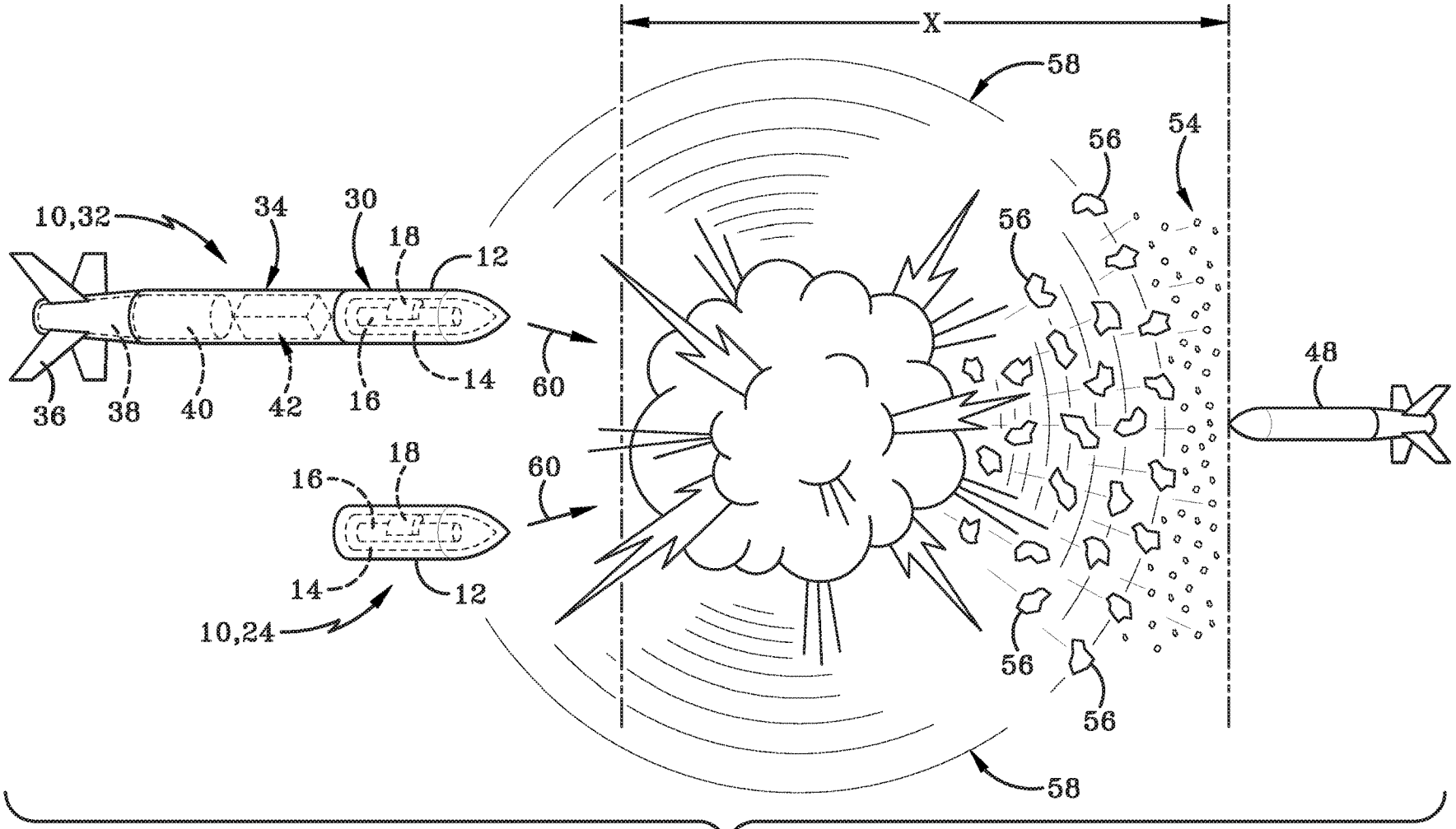
FIG. 4 (FIG. 4) is an operational perspective view of a projectile round of the present disclosure.

According to one aspect, fuse 18 may be a proximity fuse which can trigger detonation of explosive layer 14 when projectile round 10 enters to within a preset range of a target. This preset range is indicated as reference 'X' or range 'X' as seen in FIG. 4 and discussed further herein. The distance of range 'X' may vary depending on a number of factors including, but not limited to the size, explosive capacity, speed, and/or form of projectile round 10, as well as the desired implementation environment and expected threat 48 to be intercepted.

According to one aspect, proximity fuse 18 may be any type of known proximity fuse 18, including radio, optical, acoustic, magnetic, or pressure fuses. The type of proximity fuse 18 can be chosen by a person of skill according to the desired implementation.

According to another aspect, fuse 18 may be a timed fuse triggering detonation of explosive layer 14 after a certain amount of time has passed from activation. Activation may occur at the time of firing projectile round 10 towards threat 48. According to another aspect, activation of a timed fuse 18 may occur before or after projectile round 10 is fired from firing platform 10.

According to another aspect, fuse 18 may be an impact fuse which may trigger detonation of explosive layer 14 upon impact with a target or other surface. It will be further understood that other fuse types beyond those explicitly discussed herein may be adapted for use with projectile round 10 according to the desired implementation thereof.

According to one embodiment, projectile round 10 may further include inner layer 20, as seen in FIG. 1B. Inner layer 20 may be a metal or metal alloy material operable to fragment upon detonation of explosive material layer 14 as discussed further herein.

Figure 2A:
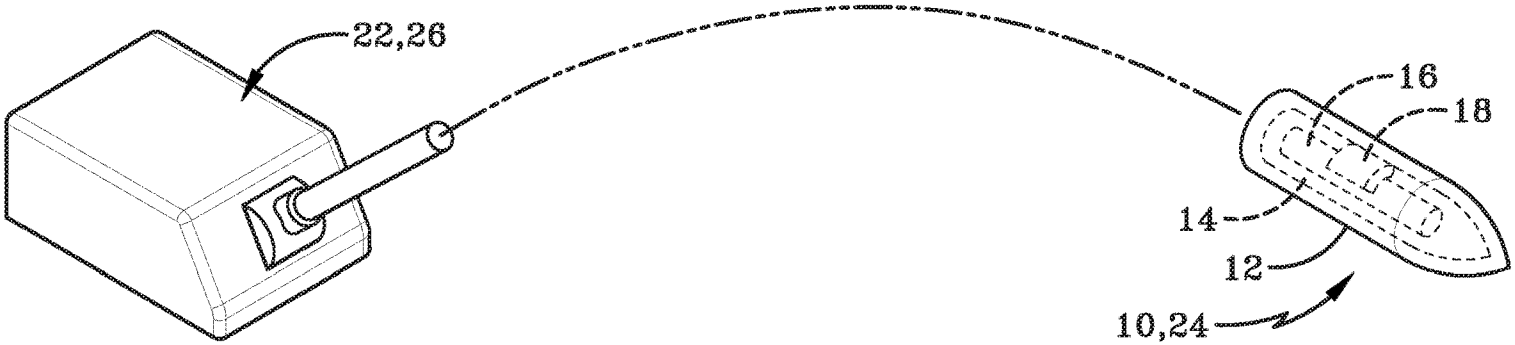
FIG. 2A (FIG. 2A) is a diagrammatic perspective view of a projectile round of the present disclosure.
Figure 2B:
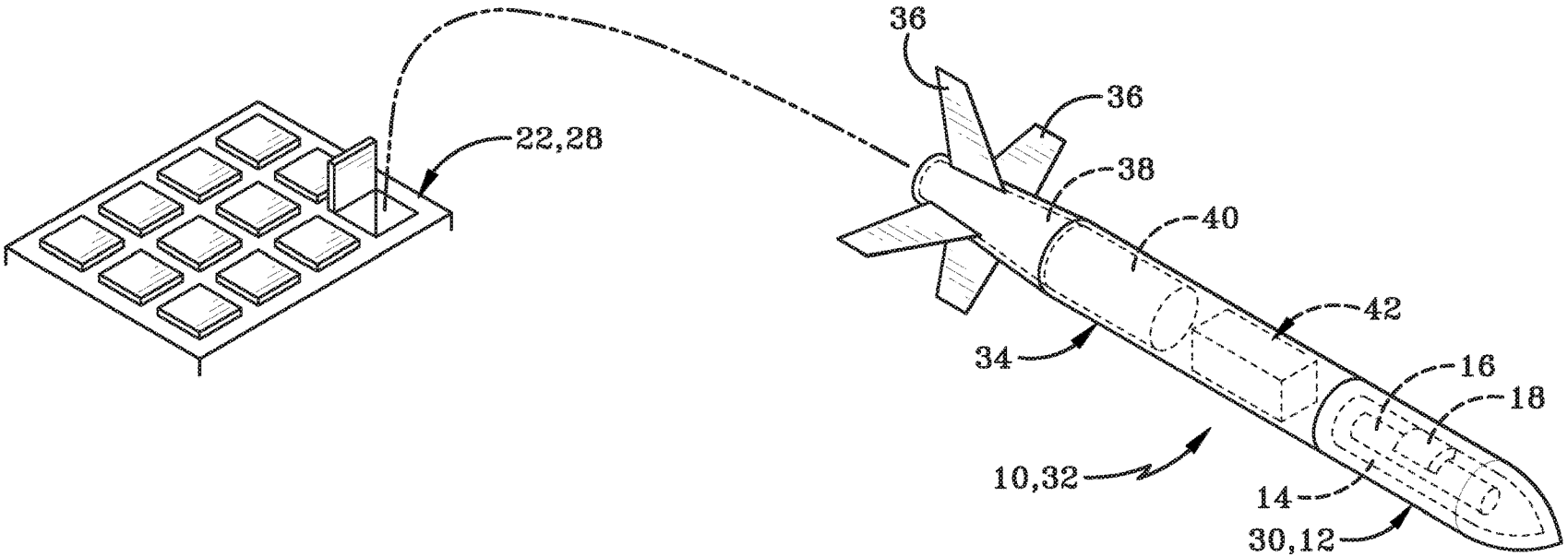
FIG. 2B (FIG. 2B) is a diagrammatic perspective view of an alternate embodiment of a projectile round of the present disclosure.

With reference to FIGS. 2A and 2B, projectile round 10 can be launched or otherwise fired from a firing platform 22 and directed towards a target. Specifically, with reference to FIG. 2A and according to one embodiment, projectile round 10 can be a ballistic round 24 which can be fired from gun 26. According to this embodiment, outer layer 12 can form a shell enclosing the explosive material layer 14, the core 16, and fuse 18, and can take a generally bullet shape. Further, according to this embodiment, when projectile round 10 is a ballistic round 24, projectile round 10 may be loaded into a separate cartridge case (not shown) containing gun powder or another propellant to effectively fire ballistic round 24 out of gun 26 according to known methods.

With reference to FIG. 2B, and according to another embodiment, projectile round 10 may form a warhead 30 which can be carried by a missile or rocket 32 that may be launched from a launcher 28. Rocket 32 may include a body 34, one or more fins 36, an engine 38, and a fuel supply 40.

Rocket 32 may also optionally include a guidance system 42 if rocket 32 is implemented as a guided munition. According to this embodiment, outer layer 12 of projectile round 10 may be an integral part of or may form a nose cone or a portion of a nose cone of rocket 32. According to another aspect, projectile round 10 may be carried entirely within rocket 32.

Figure 3:
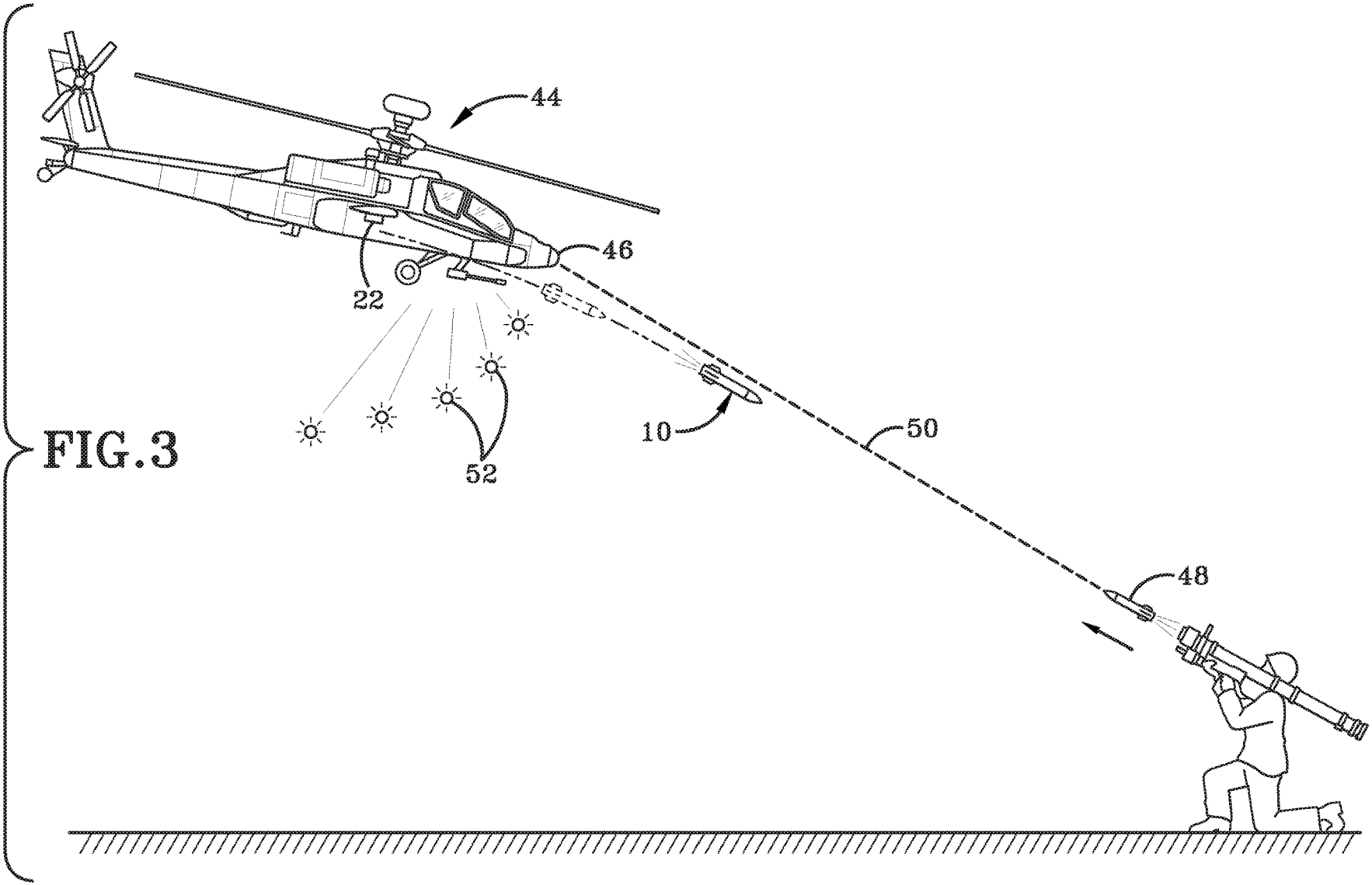
FIG. 3 (FIG. 3) is an operational perspective view of a projectile round of the present disclosure.

With reference to FIG. 3, firing platform 22 may be carried or otherwise connected to a vehicle 44, which, according to one example, may be a low-flying and/or relatively slow-moving manned or unmanned aircraft capable of operating in an enemy territory such as a helicopter. It will be understood that vehicle 44 could be any other vehicle including manned or unmanned aircraft, land-based vehicles such as tanks, trucks, or troop transports, or sea-based vehicles such as ships. According to another aspect, firing platform 22 may be a man-portable, or vehicle-portable system that may be moved between carrying vehicles 44. By way of non-limiting example, firing platform 22 may be a shoulder fired intercept system that can be carried manually or can be quickly and easily installed on a vehicle for temporary portage and or operation. According to this example, firing platform 22 may be installed on a gun mount or the like. According to another example, firing platform 22 may be interchangeable across vehicles 44 thus allowing installation and removal from various vehicle types and/or within vehicle systems.

According to one non-limiting example, vehicle 44 carrying firing platform 22 may be a dedicated vehicle for threat interception, such as a land vehicle 44 traveling as part of a convoy, as a support aircraft traveling as part of a formation and/or squadron, or as a support ship traveling within a fleet.

It is contemplated that projectile round 10 and associated firing platform 22 may form a single component of a more comprehensive countermeasure (CM) system which may include one or more additional countermeasures as discussed further herein.

Having thus described the structure of projectile round 10 and the components thereof, a method of use therefore will now be discussed.

With continued reference to FIG. 3, a vehicle 44 operating in a hostile environment may be likely to encounter multiple threats during normal operation. One such threat is an attack utilizing man-portable air defense systems (MANPADS) which are lightweight, shoulder-fired missiles designed and configured to damage or destroy a vehicle 44, such as a helicopter. These MANPADS are in use by militaries and other groups around the world and are relatively low cost and easy to obtain. Additionally, MANPADS are known to utilize guided missile systems to direct a missile at its target. As technology advances, these MANPADS increase in complexity and functionality to overcome many of the CMs deployed by modern vehicles 44, such that advances need to continue in CM technology to stay ahead of these threats.

According to another aspect, projectile round 10 may be adapted for use in intercepting other threats, not limited to MANPADS. By way of non-limiting examples, projectile round 10 may be sized and adapted for use in intercepting missiles fired from another vehicle, such as an aircraft, a mobile missile battery, or a ship. Likewise, projectile 10 may be adapted for interception of larger targets such as larger, surface-to-air missiles, intercontinental ballistic missiles, air-to-air missiles, ship based missiles, drones, aircraft (both manned and unmanned) or other such mobile threats. It will be further understood that projectile round may be scaled and/or adapted for use with a shoulder fired or man-portable intercept system.

It is contemplated that a vehicle 44 may be equipped with a firing platform 22 for projectile round 10 as one component of a comprehensive CM system. In general operation, these CM systems typically include a standard missile warning system (SMWS) 46, which can detect the launch and/or approach of an incoming threat 48, such as a guided missile. SMWS 46 may be a threat warning system utilizing one or more sensors to scan for incoming threats. According to one aspect, SMWS 46 may detect the muzzle flash of a weapon being fired utilizing an image sensor or scanner. According to this aspect, the detection of a muzzle flash may indicate an incoming threat 48 and may trigger the release of one or more CMs, including projectile round 10.

According to another aspect, SMWS 46 may detect the physical threat 48 itself. In the example where threat 48 is a missile, this would involve the detection of the physical missile. Thus, SMWS 46 may employ one or more radar elements operable to scan the operation environment for incoming threats 48. According to one non-limiting example, SMWS 46 may detect an incoming object using radar, and may then direct a more focused radar beam to identify the object as an incoming threat 48 prior to deploying CMs.

Identification of objects as incoming threats may be accomplished through any known processes. By way of non-limiting example, once SMWS 46 detects an object, it may compare the speed, size, radar signature, and other aspects of the object to a database of known threat characteristics to determine if the detected object is an incoming threat 48. As time is of the essence in these determinations, such identification is typically handled through use of onboard electronic components such as onboard computers, processors, memory, and/or logic. These systems are known and can be readily adapted for use by a person of skill according to the desired implementation.

Once an object is detected and identified as an incoming threat 48, SMWS 46 may trigger one or more CMs to deploy, which may include one or more of projectile round 10; infrared countermeasures (IRCM) 50 which use lasers to disorient or disable electronics onboard the incoming threat 48; and/or flares 52 to confuse infrared (IR) sensors carried by incoming threat 48 in an attempt to cause the threat 48 to deviate from its flight path and miss vehicle 44. Projectile round 10 is contemplated to be deployed as part of a CM system directed at interception and destruction or diversion of an incoming threat 48. According to one aspect, more than one projectile round 10 may be deployed as part of a comprehensive CM system.

With reference to FIG. 4, operation of projectile round 10 may be similar regardless of whether projectile round 10 is a ballistic round 24 or a warhead 30 such that operation of both may generally have the same operational steps.

When an incoming threat 48 is detected by a missile warning system 46 carried by a vehicle 44, as discussed above, one or more countermeasures may be contemporaneously initiated. When projectile round 10 is selected as one of the desired countermeasures, it may be launched from firing platform 22 towards the incoming threat 48 on a trajectory calculated to intercept the threat 48 away from vehicle 44. As projectile round 10 continues on its flight path, detonation of explosive layer 14 may occur at an appropriate time, determined by the type of fuse 18 contained within projectile round 10. According to one aspect, when fuse 18 is a proximity fuse, detonation of explosive layer 14 may occur when projectile round 10 closes to within a certain distance or range (illustrated in FIG. 4 as range 'X') of threat 48. According to another aspect, when fuse 18 is a timed fuse, detonation of explosive layer 14 may occur when projectile round 10 has traveled for a designated period of time calculated to place it in the vicinity (such as within range 'X') of threat 48. According to another aspect, if fuse 18 is an impact fuse, detonation of explosive layer 14 may occur when projectile round 10 impacts its target, such as threat 48.

According to one aspect, range 'X' may be in a range from 1-10 meters. According to another aspect, range 'X' may be greater than 10 meters. By way of one non-limiting example, range 'X' may be approximately 2-3 meters which may allow sufficient time for detonation of explosive layer 14 and deployment of CMs, as discussed herein, without allowing sufficient time to pass between detonation and intercept as to allow shrapnel 54 and/or chaff 56 to disperse beyond an effective distance, such as falling due to the operation of gravity. The detection of the entrance of projectile round 10 into range 'X' may vary depending upon the type of fuse 18 in use. For example, if fuse 18 is a radio proximity fuse, the entrance into range 'X' may be triggered by interference in a radio transmission and detonation may occur with the change in amplitude if the distortion exceeds a certain threshold, indicating that the target is within range.

Regardless of the type of fuse 18 contained within projectile round 10, detonation of explosive layer 14 may trigger a chain reaction of events which may occur in rapid succession. According to one aspect, these events may occur with such speed as to appear to occur simultaneously. Specifically, detonation of explosive layer 14 may cause at least a portion of outer layer 12 to fracture. According to one aspect, the outer layer 12 may fracture as a result of the detonation of explosive layer 14. According to another aspect, outer layer 12 may be pre-scored or have intentionally weakened points manufactured therein to encourage outer layer 12 to fracture in specific locations, thereby causing outer layer 12 to fracture into a plurality of pieces which may be directed towards threat 48 as shrapnel 54. Shrapnel 54 is contemplated to intercept threat 48, in an attempt to cause physical damage and/or premature detonation of threat 48.

According to another aspect, fracturing of at least a portion of outer layer 12 may result in the deployment of chaff 56, which may be or include larger pieces of material in an effort to prematurely trigger a proximity fuse within threat 48. Chaff 56 may further have radio-frequency reflective properties which may be effective to disrupt targeting abilities of threat 48.

According to another aspect, outer layer 12 may be constructed such that detonation of explosive layer 14 may cause at least a portion of outer layer 12 to fracture into both shrapnel 54 and chaff 56 components thereby resulting in two simultaneous attempts to disable threat 48.

According to one embodiment, when projectile round 10 includes inner layer 20, at least a portion of inner layer 20 may fracture upon detonation of explosive layer 14. As with outer layer 12, inner layer 20 may be pre-scored or have intentionally weakened points manufactured therein to encourage inner layer 20 to fracture in specific locations, thereby causing inner layer 20 to fracture into one of shrapnel 54 or chaff 56 while outer layer 12 may fracture into the other of shrapnel 54 or chaff 56. By way of one non-limiting example, detonation of explosive layer 14 may result in shrapnel 54 from outer layer 12 and chaff 56 from inner layer 20 such that shrapnel 54 is deployed slightly ahead of chaff 56. By way of another non-limiting example, at least a portion of outer layer 12 and at least a portion of inner layer 20 may fracture into both shrapnel 54 and chaff 56 thereby creating a mixture of both shrapnel 54 and chaff 56 over an area in the vicinity of threat 48 in an attempt to disable threat 48.

Where explosive layer 14 may be a shaped charge, detonation thereof may further cause the fractured outer layer 12 and/or inner layer 20 to be directed forward along the intercept path 60 between projectile round 10 and threat 48 such that shrapnel 54 and chaff 56 are directed outwardly towards threat 48 in an attempt to avoid unintended damages in directions away from threat 48. Further according to this aspect, where explosive layer 14 is a shaped charge, inner layer 20 may double as both a source of shrapnel 54 and/or chaff 56 and as shaped liner to direct the explosive force of explosive layer 14.

Further, as a result of the detonation of explosive layer 14, piezoelectric core 16, having piezoelectric properties as previously described herein, may be deformed and/or destroyed thereby causing a rapid release of electrical energy therefrom. This rapid release of electrical energy may take the form of an EMP 58 which may be effective to disable electronics and/or guidance components carried by threat 48, thereby attempting to disable the threat 48 by disrupting its flight pattern and/or targeting abilities.

Figure 5:
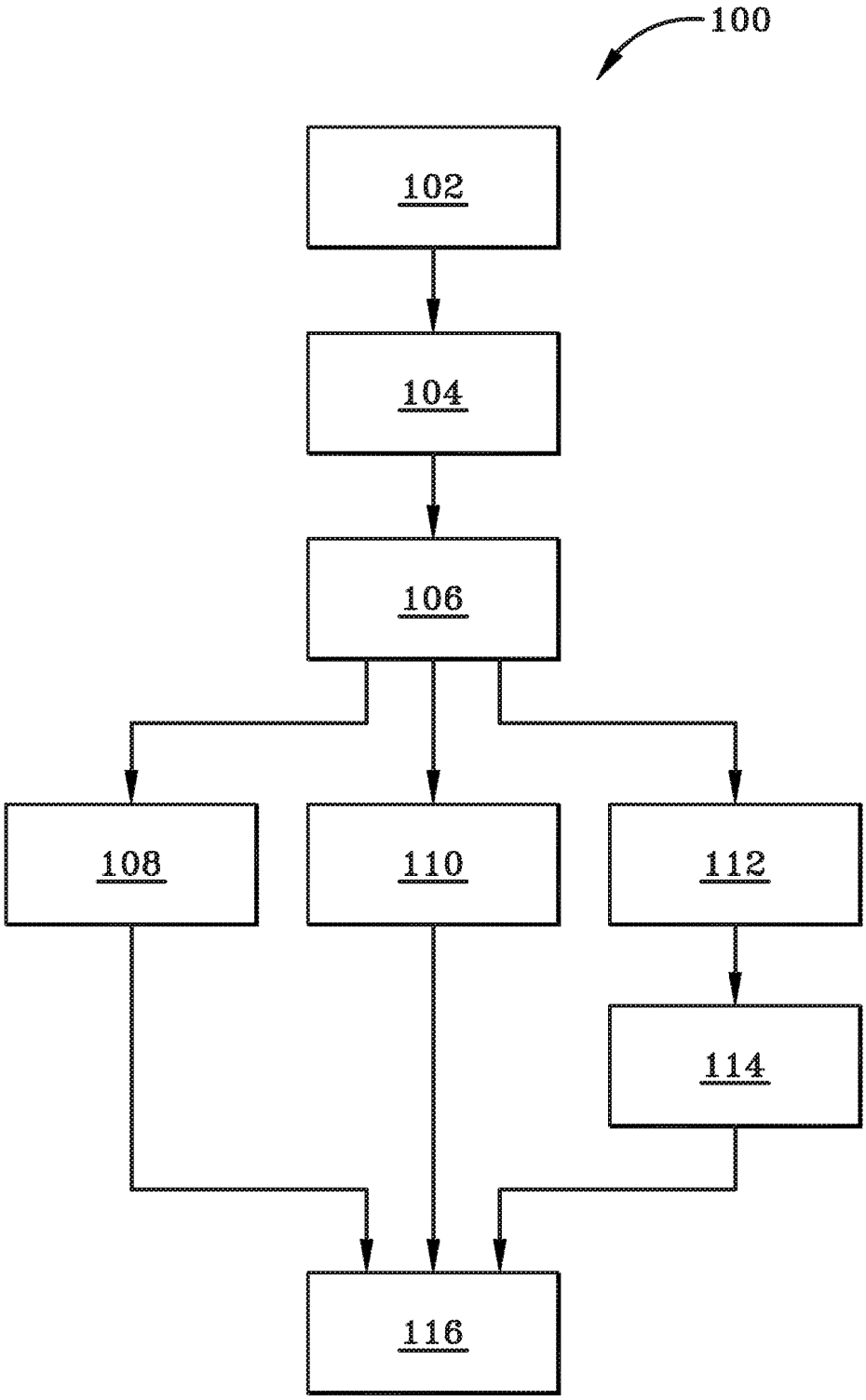
FIG. 5 (FIG. 5) is a flow chart diagram of a method of use of the present disclosure.

With reference to FIG.5, the above described method is illustrated by way of a flow chart. Specifically, method 100 of intercepting an incoming threat may be triggered by the detection 102 of the incoming threat 48 by SMWS 46. Once the threat 48 is detected 102, projectile round 10 can be fired from gun 26, launched by launcher 28, or otherwise propelled 104 towards target 48 from firing platform 22. As projectile round 10 nears the incoming threat 48, the explosive layer 14 may detonate 106 causing the deployment 108 of shrapnel 54, the deployment 110 of chaff 56, or the deployment 108, 110 of both shrapnel 54 and chaff 56. Additionally, detonation 106 of the projectile round may further deform and/or destroy 112 the piezoelectric core layer 16 causing the release 114 of an EMP 58 near the threat 48. The deployment 108 of shrapnel 54, the deployment 110 of chaff 56, the deformation/destruction 112 of the piezoelectric core layer 16, and the release 114 of the EMP 58 may occur simultaneously or in such rapid succession as to appear to be simultaneous with the detonation 106 of the projectile round 10. Once these three CMs are deployed via the detonation of the explosive layer 14 within projectile round 10, a successful implementation of method 100 may result with the interception and/or avoidance 116 of the incoming threat 48.

It will be understood, that method 100 of intercepting an incoming threat 48 may or may not result in a completely destroyed or disabled threat 48 (i.e. implementation of method 100 many not always be successful); however, method 100 may be used alone or in connection with additional CMs, such as those as discussed herein, to significantly increase the likelihood of a successful interception and/or avoidance 116 of an incoming threat 48. According to another aspect, method 100 may be used with additional CMs or as one aspect of a separate CM system, other than those discussed herein, to increase the likelihood of a successful interception and/or avoidance of an incoming threat 48.

A non-limiting example of a contemplated implementation of method 100 may include a vehicle 44, in this example, a helicopter, operating in hostile airspace. As helicopter engages in operation over hostile territory, it is likely to be observed by enemy combatants who may then engage the helicopter by deploying a guided munition, such as a missile launched from a MANPADS launcher, in an attempt to disable or destroy the helicopter. Often these types of missiles are "fire and forget" type weapons, allowing the enemy combatant to pop-up from cover, launch the threat 48, and drop back into cover before the helicopter is able to return fire or otherwise engage the combatant. Therefore, detection 102 of the incoming threat 48 by the SMWS 46 on the helicopter is important as the SMWS 46 may then activate the deployment of CMs to avoid and/or intercept the threat 48.

Projectile round 10 may be deployed as one CM and may be propelled towards the incoming threat 48 missile on a path 60 to intercept the threat 48. As projectile round 10 and threat 48 travel towards each other, the helicopter can engage in evasive maneuvers to further avoid threat 48. When projectile round 10 is within range 'X' of threat 48, the explosive layer 14 may be detonated 106 by fuse 18, causing outer layer 12 (and inner layer 20, if equipped) to fracture and deploy 108 shrapnel 54, deploy 110 chaff 56, or both shrapnel 54 and chaff 56. The detonation 106 of explosive layer 14 can also cause deformation and/or destruction 112 of the piezoelectric core 16 which may result in the release of an EMP 58 within the vicinity of threat 48. Assuming a successful interception 116 of threat 48, the result of method 100 is that the threat 48 missile is damaged, destroyed, and/or directed off course such that it does not impact or only superficially impacts the helicopter and the helicopter may continue its mission, or may return to a base with minimal damage or loss. If interception 116 is unsuccessful, other CMs, such as flares or IRCMs deployed with projectile round 10 may still abate threat 48, making projectile round 10 one of multiple desirable CMs used in connection with other CMs.

Further according to this example, as enemy combatant likely fired from cover and moved back into cover after firing, the combatant may not immediately know of the interception 116 of threat 48 until helicopter is out of range of additional attacks originating from that combatant.

Although described herein as a ballistics round 24 or warhead 30, it will be understood that projectile round 10 can be an intercept round of any type operable to intercept an incoming threat 48 according to the disclosure herein. As further described in association with an aircraft, projectile round 10 may be used from any firing platform 22 carried by any vehicle 44 as desired for the particular implementation. According to another aspect, projectile round 10 may be utilized with a stationary firing platform installation such as an anti-missile or anti-aircraft battery.

It will be further understood that projectile round 10 may be adapted for use against other targets besides missiles including, but not limited to land-based vehicles, aircraft, ships, and the like.

It will be further understood that multiple projectile rounds 10 may be carried by a single vehicle 44 and may be deployed at the discretion of the vehicle 44 operator and/or vehicle 44 systems for use in various situations without deviation from the scope herein. According to one non-limiting example, more than one projectile round 10 of the present disclosure may be deployed in response to a single incoming threat 48. According to another example, multiple projectile rounds may be deployed simultaneously or sequentially in response to more than one incoming threat 48.

Likewise, the deployment of multiple projectile rounds 10 may occur at different times in response to different threat events. For example, a vehicle 44 may encounter a threat 48 and may deploy one or more projectile rounds 10 according to the methods herein, resulting in a successful interception and/or avoidance. The same vehicle 44 may then encounter a subsequent threat at a later time, again deploying one or more projectile rounds 10 according to the methods herein.

According to one aspect, a single vehicle 44 may carry more than one type of projectile round 10 and may further deploy them as the threat situation warrants. By way of non-limiting example, a vehicle 44 may carry one or more ballistic rounds 24 along with one or more warheads 30 (including the launch vehicle, e.g. rocket 32) for use in countering threats 48 as necessary. The determination of which projectile rounds 10 are deployed may be determined by the type of threat encountered according to the methods provided herein.

Various inventive concepts may be embodied as one or more methods, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

While various inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

The indefinite articles "a" and "an," as used herein in the specification and in the claims, unless clearly indicated to the contrary, should be understood to mean "at least one." The phrase "and/or," as used herein in the specification and in the claims (if at all), should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc. As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures.

An embodiment is an implementation or example of the present disclosure. Reference in the specification to "an embodiment," "one embodiment," "some embodiments," "one particular embodiment," "an exemplary embodiment," or "other embodiments," or the like, means that a particular feature, structure, or characteristic described in connection with the embodiments is included in at least some embodiments, but not necessarily all embodiments, of the invention. The various appearances "an embodiment," "one embodiment," "some embodiments," "one particular embodiment," "an exemplary embodiment," or "other embodiments," or the like, are not necessarily all referring to the same embodiments.

If this specification states a component, feature, structure, or characteristic "may", "might", or "could" be included, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

Additionally, the method of performing the present disclosure may occur in a sequence different than those described herein. Accordingly, no sequence of the method should be read as a limitation unless explicitly stated. It is recognizable that performing some of the steps of the method in a different order could achieve a similar result.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of various embodiments of the disclosure are examples and the disclosure is not limited to the exact details shown or described.

What is claimed is:

1. A projectile round comprising:

a piezoelectric core;

a layer of explosive material surrounding the piezoelectric core;

an outer layer forming a shell enclosing the layer of explosive material and the piezoelectric core therein;

an inner layer between the layer of explosive material and the outer layer; and a fuse operable to cause the layer of explosive material to detonate.

2. The projectile round of claim 1 wherein the piezoelectric core is a piezoelectric crystal.

3. The projectile round of claim 1 wherein the outer layer fragments upon detonation of the layer of explosive material and becomes one of shrapnel and chaff.

4. The projectile round of claim 1 wherein the outer layer fragments upon detonation of the layer of explosive material and becomes both shrapnel and chaff.

5. The projectile round of claim 1 wherein the inner layer fragments upon detonation of the layer of explosive material and becomes one of shrapnel and chaff.

6. The projectile round of claim 1 wherein the inner layer fragments upon detonation of the layer of explosive material and becomes chaff and wherein the outer layer fragments upon detonation of the layer of explosive material and becomes shrapnel.

7. The projectile round of claim 1 wherein the projectile round is a ballistics projectile round.

8. The projectile round of claim 1 wherein the projectile round is an actively propelled projectile round.

9. The projectile round of claim 2 wherein the piezoelectric crystal is destroyed upon detonation of the layer of explosive material thereby releasing an electromagnetic pulse (EMP).

10. The projectile round of claim 9 further comprising:

a rocket motor; and, a fuel supply;

wherein the rocket motor is operable to actively propel the projectile round.

11. The projectile round of claim 1 wherein the fuse is a proximity fuse.

12. The projectile round of claim 1 wherein the fuse is a timed fuse.

13. A countermeasure projectile, comprising:

a piezoelectric crystal;

a layer of explosive material proximate the piezoelectric crystal;

an outer layer forming a shell enclosing the layer of explosive material and the piezoelectric crystal therein, wherein the outer layer causes at least one of shrapnel and chaff when the explosive material is detonated; and a fuse operable to cause the layer of explosive material to detonate and destroy the piezoelectric crystal core causing an electromagnetic pulse (EMP), wherein the fuse is a proximity fuse or timed fuse.

* * * * *